United States Patent [19]

Charity, III

[11] 4,281,485

[45] Aug. 4, 1981

[54] PORTABLE SUBSTRATE ETCHING APPARATUS AND PROCESS

[76] Inventor: Herman T. Charity, III, 221 Rengstorff Ave., Mountain View, Calif. 94043

[21] Appl. No.: 97,513

[22] Filed: Nov. 26, 1979

[51] Int. Cl.[3] ..... B24C 3/06; B24C 1/04

[52] U.S. Cl. ..... 51/425; 51/310; 51/426; 51/427

[58] Field of Search ..... 51/310, 311, 312, 426, 51/427, 429, 268, 272, 424, 425

[56] References Cited

U.S. PATENT DOCUMENTS

| | | | |
|---|---|---|---|
| 1,212,564 | 1/1917 | Rowe | 51/272 |
| 1,940,539 | 12/1933 | Fritsche | 51/426 |
| 2,304,071 | 12/1942 | Bellinger | 51/426 |
| 2,797,530 | 7/1957 | Garver | 51/426 |
| 3,568,567 | 3/1971 | Seck | 51/268 |
| 3,624,966 | 12/1971 | Palmer | 51/310 X |
| 4,045,915 | 9/1977 | Gilbert | 51/427 |
| 4,212,138 | 7/1980 | Hutchisen | 51/427 |

*Primary Examiner*—Gary L. Smith
*Attorney, Agent, or Firm*—Willis E. Higgins

[57] ABSTRACT

This apparatus for etching designs in a substrate, such as a glass door or window, has a transparent casing having an opening to be positioned against the substrate. A manually directable sandblasting nozzle is positioned inside the casing. A device is also provided for delivering a stream of compressed air containing sandblasting grit particles to the nozzle. The transparent casing is designed to be hand-held. In use, the substrate is masked except where the pattern is to be etched, and the transparent casing is positioned against the substrate. Sandblasting in the area of the substrate covered by the casing is carried out, and the casing moved to remaining areas of the substrate for further sandblasting until the complete design is formed in the substrate. This apparatus allows attractive designs to be formed in glass doors and windows without removing the glass from its installation.

13 Claims, 6 Drawing Figures

PORTABLE SUBSTRATE ETCHING APPARATUS AND PROCESS

BACKGROUND OF THE INVENTION

1. Field of the Invention

This invention relates to an improved portable apparatus and process for forming etched designs on substrates, such as glass doors and windows. More particularly, it relates to such an apparatus and process which can be used to make attractive designs on glass and other substrates without removing the substrate from its installation. Most especially, it relates to such a portable apparatus and method which allows an operator to monitor the progress of etching the design visually. It further relates to such a portable etching apparatus and process for abrasive etching of decorative glass while the glass being etched is in its stationary framed position, such as in a sliding glass door, a swinging door, a plate glass store-front window, or a window in a house.

2. Description of the Prior Art

In the last few years there has been a renaissance in the use of decorative glass for homes, businesses and recreational environments. Such decorative glass is usually obtained through abrasive etching, which is not a totally new art form. Headstones and other monuments have been carved in the past using a similar technique. In such processes, an adhesive stencil is placed on a glass or mirror and a design cut into the adhesive stencil corresponding to portions of the glass to be etched in the desired design. As presently practiced, the plate glass must either be etched before it is installed, or it must be removed from its frame and taken to a remote location for etching the design by placing the glass in a large sandblasting booth. Attractive and artistic designs are achieved by judging depth from shadows and the reflected nuances of light. In this manner, the artist etches the lines and curves of his design.

While portable sandblasting devices are known in the prior art as shown in, for example, U.S. Pat. No. 4,045,915, such portable sandblasters are intended for cleaning the hulls of ships or cylindrical tanks. In such devices, the surface being sandblasted is not visible to the user, nor is the sandblasting nozzle directable to achieve artistic effects.

Thus, a need remains for a portable sandblasting apparatus especially suited for providing artistic designs on glass and other substrates already installed in their intended environments.

SUMMARY OF THE INVENTION

Accordingly, it is an object of this invention to provide a portable sandblasting apparatus suitable for etching designs on glass and other substrates on site, without requiring removal from their installations.

It is another object of the invention to provide a portable sandblasting apparatus in which the sandblasting nozzle is adjustable in direction under operator control.

It is a further object of the invention to provide a portable sandblasting apparatus with which an operator may view the surface being sandblasted while sandblasting is taking place.

It is still a further object of the invention to provide a portable sandblasting apparatus in which fluid flows through the apparatus are controlled to allow easy manual movement of the apparatus along a work surface.

It is yet another object of the invention to provide such a portable sandblasting apparatus in which sandblasting grit is prevented from entering the surrounding atmosphere.

It is still another object of the invention to provide a transparent portable sandblasting apparatus in which transparent surfaces of the apparatus are protected from being scratched by ricocheting sandblasting grit.

The attainment of the foregoing and related objects may be achieved through use of the novel portable sandblasting apparatus herein disclosed. This apparatus has a transparent casing with an opening to be positioned against the glass or other substrate to be etched using the apparatus. A sealing means, such as a rim of flexible brush bristles, a rubber gasket, or the like is provided around the periphery of the opening, which is pressed against the substrate when the opening is positioned against the substrate. A manually directable sandblasting nozzle is positioned inside the casing. A means for delivering a stream of compressed air containing sandblasting grit particles is connected to the nozzle. A grit screen or other protective means for the inside surface of the transparent casing is provided, and, if a grit screen is used, has openings roughly corresponding in size to the sandblasting grit particles used. In this manner, the ricocheting grit from the surface being etched will not scratch the inside surface of the transparent casing.

In its preferred form, the apparatus has a means for withdrawing air from the transparent casing at a rate at least slightly in excess of the rate of delivery of the compressed air to the nozzle. In prior art portable sandblasting nozzles, the vacuum used for this purpose withdraws air at a much greater rate than air is delivered through the sandblasting nozzle. That approach makes the apparatus difficult to move along a surface being etched and prone to damage glass surfaces due to the pressure difference created. For this reason, it is preferred to have the rate of withdrawal of the air from the casing be only slightly in excess of its delivery rate through the nozzle, so that leakage of air into the casing through the brush bristles or other sealing means will almost completely equalize the air pressure in the casing with outside air pressure. By providing a proper balance in this manner, the apparatus is easily movable over such surfaces as glass, which are highly subject to scratching if the pressure differential is greater. However, even in this instance, it is also preferred to have resilient movable thrust members positioned to contact the substrate when the apparatus is positioned for etching. It is also preferred to have the end of the apparatus away from the opening include a flexible glove-shaped means for insertion of a hand to control the nozzle, or other control means allowing the operator to direct the nozzle and control the grit flow as desired. It is also preferred to have at least a portion of the casing be funnel shaped, so that spent sandblasting grit leaves the chamber by gravity flow. Doing so allows the rate of air withdrawal to be only slightly in excess of the air feed rate through the nozzle, because relying on the air flow for grit removal requires a very high air withdrawal rate.

The apparatus is preferably used with fluorescent lighting from the backside of a glass surface being etched. Such lighting highlights, the etching and allows easy observation of the work through one or more of the protective screens.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
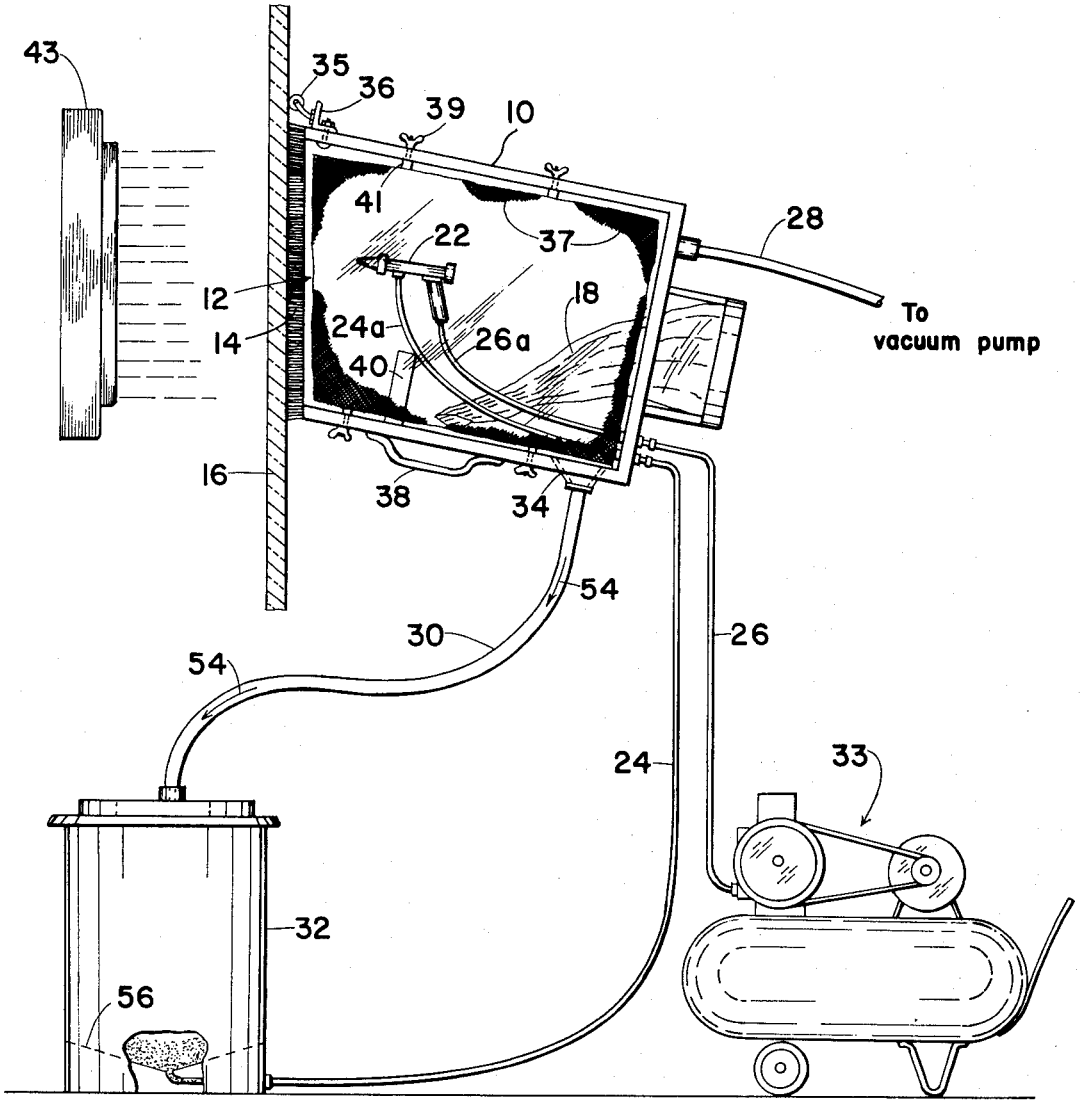
FIG. 1 is a side view of an apparatus in accordance with the invention, including a spent grit recycling means and means for supplying air flow and grit to the apparatus.
Figure 2:
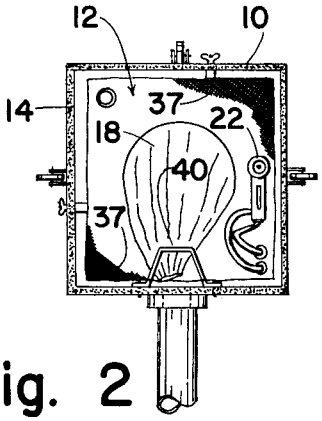
FIG. 2 is a front view of the apparatus in FIG. 1.
Figure 5:
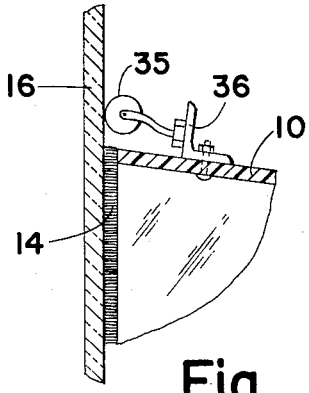
FIG. 5 is an enlarged view of a portion of the apparatus shown in FIG. 1.

Turning now to the drawings, more particularly to FIGS. 1, 2 and 5, there is shown a preferred embodiment of a portable sandblasting apparatus in accordance with the invention. The casing 10 is formed from clear plastic, glass or the like. An opening 12 forms the front of the casing 10. A rim 14 of soft bristles is positioned around the edge of the opening 12. The casing 10 is shaped as shown best in FIG. 1 so that the vertical sides of the casing when it is positioned against glass 16 or other substrate to be etched form an angle of greater than 90° to aid in gravity removal of spent sandblasting grit. A resilient glove-shaped member 18 is positioned around circular opening 20 on the back of the casing. Sandblasting nozzle 22 is mounted inside the casing 10 and is connected to a source 32 of sandblasting grit by line 24, and to a source 33 of air by line 26. Line 28 is connected to a vacuum pump (not shown). Hose 30, allowing spent grit to return by gravity flow to grit tank 32, is connected to funnel-shaped portion 34 of the casing 10. Line 24 returns the grit for reuse to the sandblasting nozzle 22, due to the Bernoulli effect produced in the nozzle by air flow supplied by line 26 to the nozzle 22.

While the amount of air removed by vacuum line 28 from the casing 10 is at a rate such that a large pressure differential does not develop between the inside and outside of the casing 10, it is preferred to provide a rubber or other resilient material thrust members 35, best shown in FIG. 5, mounted to the casing 10 by means of bracket 36 to allow easy movement of the casing 10 around the surface of glass 16 while etching is taking place. The use of such thrust members also serves to prevent damage to the glass 16 by scratching.

A protective screen 37 surrounding the interior of the casing 10 acts to prevent ricocheting grit particles from the glass 16 from scratching the interior of the casing 10 and thus imparing visual observation of the etching operation. If the protective screen 37 contains openings slightly larger than the sandblasting grit particles, the particles will be allowed to fall through the protective screen 37 and move by gravity to the grit return line 30. However, ricocheting grit particles will be prevented from contacting the interior wall of the casing 10 directly by impinging on the protective screen 37. The screen 37 may be mounted inside the casing 10 by any suitable fastening means, such as wing nuts 39 and spacers 41.

During the etching operation, glass 16 is preferably backlighted with fluorescent lamp 43. Such backlighting produces maximum light scattering in the etched areas to highlight them and increases visibility of the work through protective screen 37. In fact, such backlighting allows easy visibility of the work through two layers of the protective screen, which will give maximum protection against scratching the inside of casing 10.

To facilitate its use, the apparatus includes a handle 38 mounted to the bottom of casing 10 and an arm rest 40 inside the casing, on which the operator's forearm may be rested while directing the sandblasting nozzle 22.

Figure 3:
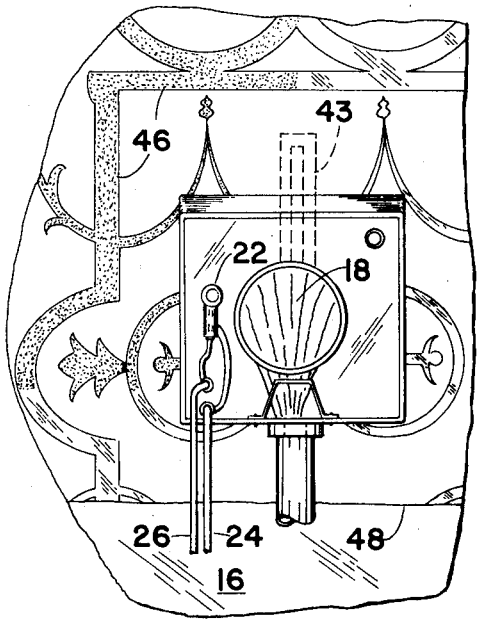
FIG. 3 is a back view of the apparatus shown in FIGS. 1 and 2.

FIG. 3 shows how the portable etching apparatus of this invention is used to produce a design on a large glass door or window 16 without requiring removal of the door or window 16 from its installation. As indicated previously, the design 46 is formed by placing the casing 10 over the glass 16 where it is to be etched, with a mask 48 covering the glass 16 except for openings corresponding to the design 46. Sandblasting is then carried out to form the design 46 in the glass 16 by insertion of the operator's hand into flexible glove-shaped member 18 to control the direction of sandblasting nozzle 22 and the flow of sandblasting grit entrained in air from the nozzle 22. The transparent casing 10 allows the operator to monitor the progress of the etching by observing shadows and nuances of reflected light. An experienced operator can achieve the desired artistic effect in the completed design through such observation.

When the operator has completed the etching of a portion of the design in an area covered by the casing 10, he moves the casing 10 to enclose another portion of the design and repeats the etching operation until that portion of the design is completed. In this manner, a much larger design than can be enclosed by the casing 10 may be formed over a substantial portion of a very large glass substrate 16.

Figure 6:
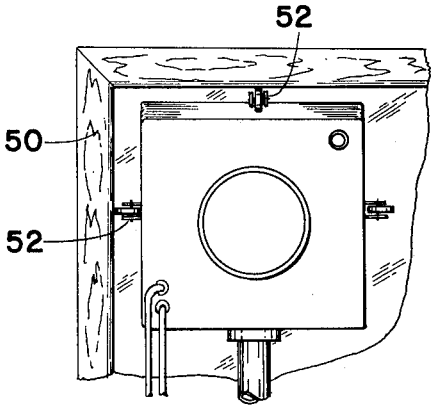
FIG. 6 shows positioning of the apparatus against a window frame during use.

As is best shown in FIG. 6, the casing 10 may be moved close to a frame 50 or other supporting means for the glass 16. The thrust members 35 (FIGS. 1 and 5) then function as stand-offs as indicated at 52 (FIG. 6) to keep the casing 10 spaced slightly away from the frame 50. It should be recognized that, in keeping with the usual rules of artistic composition, the design 46 is ordinarily spaced some distance from the frame 50, just as a picture is usually framed with a border between it and the frame.

As the etching continues, spent grit is removed from the chamber by gravity flow, as indicated by arrows 54 into tank 32. A funnel, generally indicated at 56, is desirably provided in the tank 32 for directing the spent abrasive to line 24 for reuse in the apparatus.

Figure 4:
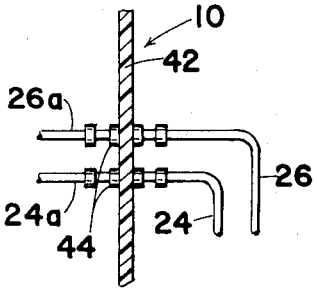
FIG. 4 is an enlarged cross-section view of a portion of the apparatus shown in FIG. 1.

FIG. 4 shows details of construction for passing the grit and air lines 24 and 26, respectively, through wall 42 of the casing 10. Fittings 44 of a double ended type are mounted in the wall 42. The grit and air lines 24 and 26 are each connected to one of the external ends of the fittings 44. Corresponding lines 24A and 26A are connected to the interior ends of the fittings 44. The other end of the lines 24A and 26A are connected to the sandblasting nozzle 22.

It should now be apparent that a portable substrate etching apparatus and process capable of achieving the stated objects of the invention has been provided. Because the etching chamber of the apparatus is small enough to be manipulated by an operator, it can be used to etch glass or other substrates at their installed location. The operator can monitor the etching process visually and move the etching chamber to cover successive portions of a large design to be formed in the glass or other substrate. The interior surface of the transparent etching chamber is protected against abrasion by a protective screen surrounding it. The air flow through the etching chamber is controlled to allow easy movement of the etching chamber over the glass surface while the apparatus is in use.

It should further be apparent to those skilled in the art that various changes in form and details of the invention as described above may be made. It is intended that such changes be included within the spirit and scope of the claims appended hereto.

What is claimed is:

1. Apparatus for etching designs in a substrate, which comprises:
   (a) a transparent casing having an opening to be positioned against the substrate,
   (b) a sealing means around the opening of said casing and which is pressed against the substrate when the opening is positioned against the substrate,
   (c) a manually directable sandblasting nozzle positioned inside said casing,
   (d) means for delivering a stream of compressed air containing sandblasting grit particles to said nozzle,
   (e) a protective screen having openings which allow visual observation of the substrate through said screen and allow grit particles to pass through said screen, said screen preventing ricocheting grit particles from the substrate from contacting said casing directly, said screen being positioned between said sandblasting nozzle and said transparent casing, and
   (f) means for withdrawing air from said transparent casing at a rate at least slightly in excess of the rate of delivery of the compressed air to said nozzle.

2. The apparatus of claim 1 additionally comprising a sandblasting grit receiving means connected to said casing.

3. The apparatus of claim 2 in which said casing is shaped so that spent sandblasting grit enters said grit receiving means by gravity flow.

4. The apparatus of claim 1 additionally comprising resilient rollable thrust members positioned to contact the substrate when said casing is positioned against the substrate.

5. The apparatus of claim 1 in which said transparent casing has an end facing away from the opening including a flexible glove-shaped means for insertion of a hand to control said manually directable nozzle.

6. A portable substrate etching apparatus, which comprises:
   (a) a transparent casing having an opening at one end to be positioned against the substrate,
   (b) a manually directable sandblasting nozzle in said casing,
   (c) means for supplying sandblasting grit entrained in a pressurized fluid to said sandblasting nozzle,
   (d) means for removing spent grit from said casing by gravity flow, comprising a funnel-shaped bottom portion of said casing, and
   (e) means, independent of said spent grit removing means, for removing the fluid at a rate slightly in excess of the rate it enters said casing through said nozzle.

7. A portable substrate etching apparatus, which comprises:
   (a) a transparent casing having an opening at one end to be positioned against the substrate,
   (b) a manually directable sandblasting nozzle in said casing,
   (c) means for supplying sandblasting grit entrained in a pressurized fluid to said sandblasting nozzle, and
   (d) a resilient hand insertion means at another end of said casing remote from the one end.

8. A portable substrate etching apparatus, which comprises:
   (a) a transparent casing having an opening at one end to be positioned against the substrate,
   (b) a manually directable sandblasting nozzle in said casing,
   (c) means for supplying sandblasting grit entrained in a pressurized fluid to said sandblasting nozzle, and
   (d) a protective screen having openings which allow visual observation of the substrate through said screen and allow grit particles to pass through said screen, said screen further preventing ricocheting grit particles from the substrate from contacting said casing directly, said screen surrounding at least a portion of the inside of said casing.

9. The substrate etching apparatus of claim 8 additionally comprising a second layer of protective screen having openings which allow visual observation of the substrate through the second layer of screen and allow grit particles to pass through the second layer of screen, said second layer of screen surrounding at least a portion of the inside of said casing, and further preventing ricocheting grit particles from the substrate from contacting said casing directly.

10. A method for etching designs in a substrate, which comprises:
   (a) masking the substrate except where the design is to be formed,
   (b) placing a transparent housing including a manually directable sandblasting nozzle and an opening over a portion of the substrate, with the opening against the substrate,
   (c) directing the nozzle at the exposed areas of the portion of the substrate to sandblast them,
   (d) moving the transparent housing to cover another portion of the substrate including an exposed area forming another portion of the design,
   (e) directing the nozzle at the exposed area of the other portion of the substrate to sandblast it,
   (f) withdrawing air from the transparent housing at a rate slightly in excess of a rate air enters the housing through the sandblasting nozzle, and
   (g) removing spent sandblasting grit from the housing and recycling it to the sandblasting nozzle.

11. The method of claim 10 in which the substrate is glass and additionally comprising the step of backlighting the glass while carrying out the sandblasting steps.

12. Apparatus for etching a substrate, which comprises:
   (a) a casing for enclosing at least a surface to be etched of the substrate, said casing including at least a transparent portion for viewing the surface,
   (b) a manually directable sandblasting nozzle positioned inside said casing, (c) means for delivering a stream of compressed air containing sandblasting grit particles to said nozzle, and (d) a protective screen having openings which allow visual observation of the substrate through said screen and the transparent portion of said casing and allow grit particles to pass through said screen, said screen preventing ricocheting grit particles from the substrate from contacting the transparent portion of said casing directly, said screen being positioned between at least the surface of the substrate and the transparent portion of said casing.

13. The substrate etching apparatus of claim 12 additionally comprising a second layer of protective screen having openings which allow visual observation of the substrate through said second layer of protective screen, said protective screen and the transparent portion of said casing, said second layer of protective screen being positioned between at least the surface of the substrate and the transparent portion of said casing, and further preventing ricocheting grit particles from the substrate from contacting the transparent portion of said casing directly.

* * * * *